US009593694B2

(12) United States Patent
Welschinger et al.

(10) Patent No.: US 9,593,694 B2
(45) Date of Patent: Mar. 14, 2017

(54) PUMP

(71) Applicant: Sulzer Pumpen AG, Winterthur (CH)

(72) Inventors: Thomas Welschinger, Radolfzell (DE); Marcelo Inforsati, Winterthur (CH)

(73) Assignee: Sulzer Management AG, Winterthur (CH)

( * ) Notice: Subject to any disclaimer, the term of this patent is extended or adjusted under 35 U.S.C. 154(b) by 391 days.

(21) Appl. No.: 14/245,309

(22) Filed: Apr. 4, 2014

(65) Prior Publication Data

US 2015/0285251 A1 Oct. 8, 2015

(51) Int. Cl.

| | |
|---|---|
| ***F04D 29/08*** | (2006.01) |
| ***F04D 1/06*** | (2006.01) |
| ***F04D 29/42*** | (2006.01) |
| ***F04D 29/62*** | (2006.01) |

(52) U.S. Cl.

CPC ..... *F04D 29/086* (2013.01); *F04D 1/063* (2013.01); *F04D 29/426* (2013.01); *F04D 29/628* (2013.01)

(58) Field of Classification Search

CPC ..... F04D 29/086; F04D 29/426; F04D 1/063; F04D 29/628

USPC ..... 415/199.2, 199.4, 199.5, 214.1; 416/198 A

See application file for complete search history.

(56) References Cited

U.S. PATENT DOCUMENTS 3,802,795 A * 4/1974 Nyeste ..... F04D 17/125 415/122.1
4,493,611 A * 1/1985 Funakoshi ..... F01D 9/026 415/199.1
4,778,334 A * 10/1988 Medgyesy ..... F04D 1/066 415/199.1
5,456,577 A * 10/1995 O'Sullivan ..... F04D 1/06 415/140
6,884,031 B2 * 4/2005 Gregory ..... F04D 1/063 415/199.2
2003/0021681 A1 1/2003 Gregory

FOREIGN PATENT DOCUMENTS

| | | | |
|---|---|---|---|
| CH | 637185 | A5 | 7/1983 |
| EP | 0248104 | A1 | 12/1987 |
| JP | S5641482 | A | 4/1981 |

OTHER PUBLICATIONS

Search Report mailed Mar. 4, 2013, from European Application No. 12187834.2 (5 pages).

* cited by examiner

*Primary Examiner* — Hoang Nguyen
(74) *Attorney, Agent, or Firm* — Kilpatrick Townsend & Stockton LLP

(57) ABSTRACT

A pump including an outer housing having an outlet chamber with an outlet connector, and including a first part pump and a second part pump connected thereafter, with the first and second part pumps being arranged in the outer housing, a separating element which can be arranged between the first and second part pumps and a rotor shaft which is rotatably arranged in the first and second part pumps. In accordance with the invention, the outer housing, the first part pump and the separating element bound a first pressure chamber and the outer housing, the second part pump and the separating element bound a second pressure chamber and the first and second pressure chambers are designed and arranged such that the outlet chamber is formed as a single high-pressure region of the pump.

12 Claims, 1 Drawing Sheet

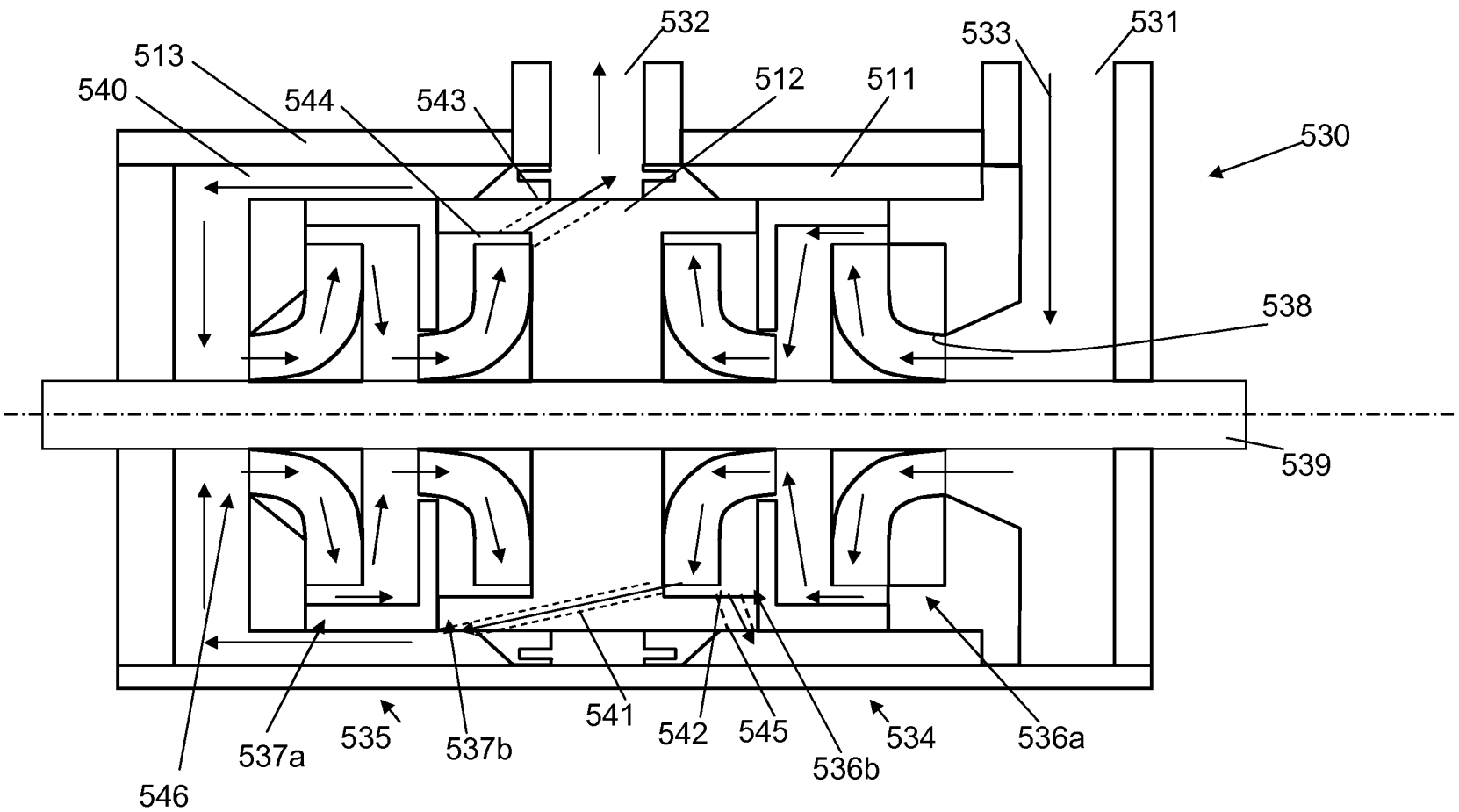
530
531
533
511
512
532
543
544
513
540
538
539
536a
534
536b
545
542
541
537b
535
537a
546

PUMP

The invention relates to a pump in accordance with the preamble of claim 1.

Pumps, in particular multistage high-pressure pumps, are well-known flow machines from the prior art and are used in the most varied applications for conveying pump fluids, in particular liquids or mixtures. The multistage high-pressure pump is composed of an outer housing in which a plurality of pump modules are arranged, wherein the pump modules include a stator and an impeller. The individual pump modules which correspond to the individual stages of the pump are axially arranged on a rotor shaft, wherein a plurality of pump modules, which are connected behind one another, can form a part pump having an input and an output for the pump fluid. In a so-called "back-to-back" configuration, a first and a second part pump are arranged in the axial direction along the rotor shaft with an opposite flow direction and a first pump output of the first part pump is in flow communication with a second pump input of the second part pump. The pressure on the pump fluid is in this respect increased from a first pump input of the first part pump successively in each pump module. The pressure on the pump fluid at the first pump output thus corresponds to the pressure at the second pump input of the second part pump, with the pressure present in this region being able to be called an average pressure. In the second part pump, the pressure on the pump fluid is in turn, analog to the first part pump, increased successively in each pump module and the pump fluid is subsequently conducted on to an outlet chamber at high pressure. In multistage high-pressure pumps, the outlet chamber is in this respect connected to a pressure chamber which is bounded by the outer housing and the first and second part pumps arranged therein as well as by a dividing element so that a region arises within the outer housing in which the pump fluid which is at high pressure is located.

A multistage high-pressure pump is disclosed in EP 0 766 007 B1 which includes a cylindrical outer housing having an outlet chamber and includes a cover for a side of the outer housing and a first and second part pump in a "back-to-back" arrangement. As already mentioned, the pump also includes a pressure chamber which is connected to the outlet chamber which is at high pressure. The solution described in EP 0 766 007 B1 provides that a axial portion of the pressure chamber which is at high pressure is separated from a radial portion of the pressure chamber by means of a seal. The portion of the pressure chamber formed in the radial direction is connected to the first pump output of the first part pump so that the pressure level corresponds to half the high pressure. The portion of the pressure chamber which is formed in the axial direction and which is connected to the outlet chamber forms an axial portion of the pressure chamber extending along the outer housing and is thus at high pressure.

The pressure chambers of a multistage high-pressure pump, which are at high pressure and which are located within the outer housing, are accompanied by high technical demands. For example, the outer housings must be designed as larger as the pressure increases and larger and larger wall thicknesses and diameters of the outer housings become necessary, whereby the costs for the pumps increase. A further important reason to reduce the pressure within the outer housing is the occurrence of deformations at or the displacement of components which results in an excessive reduction in size of the gaps between the components and thus causes wear of the components.

Against this background, it is the object of the invention to propose an inexpensive pump with material efficiency.

In accordance with the invention, this object is satisfied by a pump having the features of claim 1.

The pump includes an outer housing having an outlet chamber with an outlet connector, and includes a first part pump and a second part pump connected downstream, with the first and second part pumps being arranged in the outer housing, a separating element which can be arranged between the first part pump and the second part pump and a rotor shaft which is rotatably arranged in the first and second part pumps.

The outer housing can, for example, be designed as a primarily hollow-cylindrical or tubular housing in which the outlet chamber is arranged, for example, as a cylindrical opening in the outer housing. The pump can be formed, for example, from a first part pump and a second part pump, with each part pump being formed from one or more pump modules and the first part pump including a first pump input. Each pump module in this respect includes a stator and an impeller. The individual pump modules, which correspond to individual pump stages, are arranged axially behind one another on the rotor shaft. The first and second part pumps are in particular formed from the same number of pump modules, with an output of the pump module n−1 within a part pump being in flow communication with an input of the pump module n. The individual pump modules can, for example, be screwed to one another or can simply be joined to one another. The separating element is arranged between the first and second part pumps and can, for example, be screwed to the two part pumps.

In accordance with the invention, the pump is designed so that the outer housing, the first part pump and the separating element bound a first pressure chamber and the outer housing, the second part pump and the separating element bound a second pressure chamber and the first and second pressure chambers are designed and arranged so that the outlet chamber is formed as a single high-pressure region of the pump.

In this connection, a high-pressure should be understood as a pressure which is only present in the outlet chamber in the operating state of the pump and which corresponds to the highest pressure in the pump. The first and second pressure chambers are pressure chambers extended in the axial direction along the outer housing. The pressure formed in the first and second pressure chambers corresponds, for example, to a pressure of the part pumps or of one of the pump modules, but not to the high pressure in the outlet chamber. There is thus no region which is at high pressure present within the outer housing of the pump in accordance with the invention. The high-pressure region can, for example, be formed by means of the outlet chamber or by means of the outlet chamber and a groove in the separating element.

It is the advantage of the high-pressure region that, due to the lower pressure within the outer housing, the wall thicknesses and the size of the outer housing can, for example, be reduced.

In an embodiment of the invention, the first pressure chamber and the outlet chamber and the second pressure chamber and the outlet chamber are separated from one another by the separating element. The separating element is made in two parts and a part of a stator of a pump module is formed as a part of the separating element.

The separating element is arranged between the first and second part pumps and separates the first and second pressure chambers from the high-pressure region. The separating element can, for example, be formed from the stator of the last pump module of one of the pump modules in dependence on the arrangement of the part pumps. The stator in this respect bounds the first pressure chamber, for example, and the other part of the separating element bounds the second pressure chamber, or vice versa.

In an embodiment of the invention, a first sealing element is arranged between the first pressure chamber and the outlet chamber and a second sealing element is arranged between the second pressure chamber and the outlet chamber. The first and second sealing elements are arranged between the separating element and the outer housing. In an embodiment variant, the first sealing element is arranged between a stator of a pump module and the outer housing and the second sealing element is arranged between the separating element and the outer housing.

The separating element is arranged between a first pump output of the first part pump and a second pump output of the second part pump and bounds the outlet chamber. The first and second sealing elements are made as seals, in particular as an O ring made from an elastomeric material or from metal. It is also possible that two or more sealing elements, in particular O rings, are arranged next to one another. The first and second sealing elements are arranged between or at the separating element and/or the outer housing since they spatially bound the first and second pressure chambers. In a further embodiment, for example, the first sealing element is arranged between or at a stator of a pump module, in particular the last pump module of the first part pump, and the outer housing and the second sealing element is arranged between or at the other part of the separating element and the outlet chamber, or vice versa. The first and second sealing elements can in this respect be arranged in a groove of the separating element or of the outer housing, for example.

It is likewise possible that both the separating element and/or the stator of a pump module and the outlet chamber have a sealing element. The sealing element can also be designed as a different type of seal, for example in the form of a metal seal, a flat seal or a coating, for example with an elastic material. In this embodiment, the sealing element is considered either as belonging to the separating element or to the outlet chamber. On use of a sealing element, a particularly good seal of the high-pressure space can be achieved.

It is, however, also possible that the separating element, the outlet chamber and the first or second pressure chambers are designed and arranged so that they form a receiving space in which an O ring is arranged. The separating element, the outlet chamber and the first or second pressure chambers for this purpose have corresponding edges or steps which in particular form a receiving ring rectangular in cross-section for the O ring. It is thus not necessary to provide a groove at the separating element or termination element, which makes the manufacture of the separating element or of the termination element particularly simple.

In an embodiment of the invention, the first pressure chamber includes a compensation opening and the second pressure chamber includes an inlet opening and/or an output of a pump module is in flow communication with the compensation opening of the first pressure chamber by means of a compensation line. The compensation line can in this respect be arranged in the stator of the pump module or in the separating element. In a preferred embodiment of the invention, a first pump output of the first part pump is in flow communication with the compensation opening of the first pressure chamber by means of the compensation line and with the inlet opening of the second pressure chamber by means of a pressure line.

Since a compensation opening and an inlet opening are provided in the first and second pressure chambers so that the infeed of a pump fluid at a lower pressure level than the high pressure is possible, the first and second pressure chambers have a lower pressure than the high pressure in the outlet chamber. The compensation opening and the inlet opening can be designed, for example, as bores or connectors. The first and second pressure chambers can be connected to an output of a pump module and the pressure in the first and second pressure chambers can thus correspond to a pressure level of an output of a pump module. In a preferred embodiment, the first and second pressure chambers are in flow communication with the first pump output of the first part pump, that is the second pressure chamber by means of the compensation opening and a compensation line and the first pressure chamber by means of the inlet opening and a pressure line. In this respect, the first pump output of the first part pump is to be understood as the last pump module of the first part pump which has approximately half the high pressure so that the first and second pressure chambers advantageously have approximately the pressure level of half the high pressure. The first and/or second pressure chambers can, however, also have a different pressure level in that the compensation line is not connected to the first pump output of the first part pump, but rather to an output of any desired pump module.

The advantages of the pump in accordance with the invention which is provided for conveying a gaseous or liquid pump fluid such as water, mineral oil or similar come into effect in pumps at very high pressures such as at pressures of up to 1300 bar, since their outer housings can be designed with smaller wall thicknesses and smaller diameters.

Since the outlet chamber is designed as a single high-pressure region of the pump, it is possible to maintain the pressure within the remaining outer housing at a uniform lower pressure level. The arrangement of the first and second pressure chambers as well as of the sealing elements and of the separating element serves for the bounding and sealing of the high-pressure region which thus form a bounded and single region which is at a high pressure. The deformations and displacement of different components occurring at high pressures are thereby reduced, losses due to separate pressure chambers having different pressures are reduced and the costs in the manufacture of the pump are minimized due to the smaller dimension.

In an embodiment of the invention, the second pressure chamber is designed as a second pump input for the second part pump and/or the second part pump includes a second pump output and the second pump output is in flow communication with the outlet chamber by means of an outlet line.

The pump has at least one first and one second downstream part pump, with the second pump output being connected to the outlet chamber by means of the outlet line and having high pressure. "Downstream" is to be understood in this respect such that the first pump output of the first part pump is connected to the second pump input of the second part pump. The first pump output is in this respect connected by means of the pressure line and the inlet opening to the second pressure chamber, with the second pressure chamber simultaneously being designed as a second pump input for the second part pump. The pressure at the first pump output is thus smaller than at the second pump output.

In an embodiment of the invention, the compensation line, pressure line and outlet line are arranged in the separating element or the compensation line is arranged in the stator of the pump module and the pressure line and the outlet line are arranged in the separating element.

The separating element is arranged between the first and second part pumps and is designed as a boundary between the first and second part pumps. The compensation line and the pressure line, which connect the first and second part pumps to the first and second pressure chambers, and the outlet line, which connects the second part pump and the outlet chamber, can be arranged in the separating element, for example. The compensation line can, however, also be arranged in the stator of any desired other pump module, for example. The compensation line, pressure line and outlet line can be designed, for example, as bores, lines or tubes. It is advantageous that the pump can thereby be designed in a more compact construction and the bores, lines or tubes are not arranged as separate components and the pumps can thus be manufactured less expensively and with greater material efficiency.

In an embodiment of the invention, the first and second part pumps are arranged so that a first flow direction is oriented in the first part pump and a second flow direction is oppositely oriented in the second part pump.

The pump is in particular designed as a multistage radial centrifugal pump. In such a pump, at least two pump modules each having an impeller are arranged after one another. The first and second part pumps are arranged within the pump so that a first flow direction is oriented in the first part pump and a second flow direction is oppositely oriented in the second part pump. The named flow direction in this respect relates to the flow direction in an impeller of a part pump. The pump then has a so-called back-to-back arrangement. This arrangement has the advantage that axial forces which arise at the impellers cancel one another out at least in part and thus a support of the pump becomes simpler and takes up less construction space.

Further advantages, features and details of the invention result with reference to the following description from embodiments and with reference to drawings in which elements which are the same or have the same function are provided with identical reference numerals.

There are shown:

FIG. 1 a pump having two part pumps in a back-to-back arrangement.

In accordance with FIG. 1, a pump 530 has an external housing 513 designed as a housing and having a first pump input 531 of the pump 530 and an outlet chamber 532. The pump 530 sucks in pump fluid, for example in the form of water or mineral oil, via the first pump input 531 and outputs the pump fluid again at high pressure via the outlet chamber 532. The flow of the pump fluid in the pump 530 is shown by arrows 533, with a reference numeral not being associated with every arrow. The pump 530 is designed as a pump having a first part pump 534 and a second part pump 535 downstream thereof. The first part pump 534 is composed of two pump modules 536*a* and 536*b* connected behind one another and the second part pump 535 is composed of two pump modules 537*a* and 537*b* connected behind one another, with the pump modules corresponding to the individual pump stages. The pump modules 536*a*, 536*b*, 537*a*, 537*b* are all basically of identical structure. They all contain an impeller 538 which is rotationally fixedly connected to a rotor shaft 539. The rotor shaft 539 is driven by a drive engine, not shown, so that the impeller 538 rotates together with the rotor shaft 539. Pump fluid is supplied radially inwardly to the impeller 538 and exists the impeller 538 radially outwardly again in a known manner at a higher pressure. The pump 530 is therefore designed as a multistage radial centrifugal pump. After exiting the first pump module 536*a* of the first part pump 534, the pump fluid is supplied to the axially adjacent second pump module 536*b* of the first part pump 534. A flow direction of the pump fluid thus runs from right to left in the first part pump 534 in FIG. 1.

The first part pump 534 is separated from the second part pump 535 by a separating element 512 which is arranged axially next to the second pump module 536*b* of the first part pump 534. The separating element 512 does not rotate with the rotor shaft 539. The second pump module 537*b* adjoins the separating element 512 in the axial direction and then the first pump module 537*a* of the second part pump 535, with the pump modules 537*a*, 537*b* of the second part pump 535 being arranged in mirror form in comparison with the pump modules 536*a*, 536*b* of the first part pump 534. For this reason, this arrangement of the two part pumps 534 and 535 is also called a back-to-back arrangement.

The outer housing 513, the first part pump 534 and the separating element 512 bound a first pressure chamber 511 in the axial direction and the outer housing 513, the second part pump 535 and the separating element 512 bound a second pressure chamber 540. In addition, the first pressure chamber includes a compensation opening and the second pressure chamber includes an inlet opening which are not marked due to the degree of detail.

The seal between the outlet chamber which is at high pressure and the first and second pressure chambers 511, 540 will be described in the following, but is not shown in FIG. 1. The separating element 512 has a beaker-shaped base shape and is closed by the outer housing 513. The separating element 512 is connected to the pump modules 536*b*, 537*b*, for example by means of screw connections not shown in FIG. 1, and is arranged in the outer housing 513 so that there is contact between an outer sealing surface of the separating element 512 and an inner sealing surface of the outer housing 513. The outer sealing surface of the separating element 512 has a peripheral groove in which an O ring (not shown) made from an elastomeric material is arranged. The groove and the O ring can also be arranged in the outer housing 513. A second O ring can also be arranged in parallel this O ring.

The separating element 512 has a cut-out which is open to the outlet chamber 532 and which is arranged so that the groove and the O ring, and thus a part of the outer contact surface, are arranged between the cut-out and the inner contact surface of the outer housing 513. A peripheral marginal region at which the groove and the O ring are arranged thus results at the separating element 512. This marginal region is elastic to a limited extent in at least the axial direction. The outlet chamber 532 is thus a region separate from the first and second pressure chambers 511, 540 with respect to the pressure.

The pump fluid is supplied to the first pump module 537*a* of the second part pump 535 via the second pressure chamber 540 which first leads axially past the outer housing 513 of the second part pump 535 and then leads radially inwardly to a second pump input 546 of the first pump module 537*a* of the second part pump 535. The pump fluid is then conducted from the first pump module 537*a* to an input of the second pump module 537*b* of the second part pump 535 arranged between the first pump module 537*a* and the separating element 512. The flow direction of the pump fluid in the second part pump 535 thus runs from left to right in FIG. 1, that is opposite to the flow direction in the first part pump 534.

To conduct the pump fluid from the first part pump 534 to the second part pump 535, the separating element 512 has a pressure line 541 which is in flow communication with the inlet opening of the second pressure chamber 540 and leads from a first pump output 542 of the second pump module 536*b* of the first part pump 534 to the second pressure chamber 540. In addition, a compensation line 545 is arranged at the separating element 512 and is in flow communication with a compensation opening of the first pressure chamber 511, whereby the pump fluid is conducted from the first pump output 542 of the second pump module 536*b* of the first part pump 534 to the first pressure chamber 511. The first and second pressure chambers 511, 540 are thus at the same pressure level.

In addition, the separating element 512 has an outlet line 543 which leads from a second pump output 544 of the second pump module 537*b* of the second part pump 535 to the outlet chamber 532. A pressure is present in the first pressure chamber 511 and in the second pressure chamber 540 which is lower in comparison with the outlet chamber 532 so that the first and second pressure chambers 511, 540 can also be called an average pressure space.

The outer housing 513 has a predominantly cylindrical inner contour in the region of the separating element 512. The boundary between the outlet chamber 532 which is at high pressure and the first and second pressure chambers 511, 540 takes place by the separating element 512 in the axial direction.

The invention claimed is:

1. A pump including:

an outer housing having an outlet chamber with an outlet connector;

a first part pump and a second, downstream part pump, wherein the first and second part pumps are arranged in the outer housing;

a separating element which can be arranged between the first and second part pumps; and a rotor shaft which is rotatably arranged in the first and second part pumps, wherein the outer housing, the first part pump and the separating element bound a first pressure chamber and the outer housing, the second part pump and the separating element bound a second pressure chamber and the first and second pressure chambers are designed and arranged such that the outlet chamber is formed as a single high-pressure region of the pump, and the first pressure chamber includes a compensation opening and the second pressure chamber includes an inlet opening, wherein an output of a pump module is in flow communication with the compensation opening of the first pressure chamber by means of a compensation line.

2. The pump according to claim 1, wherein the first pressure chamber and the outlet chamber and the second pressure chamber and the outlet chamber are separated from one another by the separating element.

3. The pump according to claim 1, wherein the separating element is made in two parts and a part of the stator of a pump module is formed as a part of the separating element.

4. The pump according to claim 1, wherein a first sealing element is arranged between the first pressure chamber and the outlet chamber and a second sealing element is arranged between the second pressure chamber and the outlet chamber.

5. The pump according to claim 4, wherein the first and second sealing elements are arranged between the separating element and the outer housing.

6. The pump according to claim 4, wherein the first sealing element is arranged between a stator of a pump module and the outer housing and the second sealing element is arranged between the separating element and the outer housing.

7. The pump according to claim 1, wherein the compensation line is arranged in the stator of the pump module or in the separating element.

8. The pump according to claim 1, wherein a first pump output of the first part pump is in flow communication with the compensation opening of the first pressure chamber by means of the compensation line and with the inlet opening of the second pressure chamber by means of a pressure line.

9. The pump according to claim 1, wherein the second pressure chamber is formed as a second pump input for the second part pump.

10. The pump according to claim 1, wherein the second part pump includes a second pump output and the second pump output is in flow communication with the outlet chamber by means of an outlet line.

11. The pump according to claim 10, wherein the compensation line, the pressure line and the outlet line are arranged in the separating element or the compensation line is arranged in the stator of the pump module and the pressure line and the outlet line are arranged in the separating element.

12. The pump according to claim 1, wherein the first and second part pumps are arranged so that a first flow direction is oriented in the first part pump and a second flow direction is oppositely oriented in the second part pump.

* * * * *